US007984707B2

(12) United States Patent
Anzo et al.

(10) Patent No.: US 7,984,707 B2
(45) Date of Patent: Jul. 26, 2011

(54) IGNITION COIL DEVICE FOR INTERNAL COMBUSTION ENGINE

(75) Inventors: Yoichi Anzo, Hitachinaka (JP); Makio Takahashi, Hitachinaka (JP); Takanobu Kobayashi, Tokai (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/835,766

(22) Filed: Jul. 14, 2010

(65) Prior Publication Data

US 2010/0275893 A1 Nov. 4, 2010

Related U.S. Application Data

(63) Continuation of application No. 11/597,426, filed as application No. PCT/JP2005/013836 on Jul. 28, 2005, now Pat. No. 7,789,078.

(30) Foreign Application Priority Data

Jul. 28, 2004 (JP) ..... 2004-220353
Mar. 28, 2005 (JP) ..... 2005-091277

(51) Int. Cl.
*H01F 38/12* (2006.01)
*F02P 11/00* (2006.01)

(52) U.S. Cl. ..... 123/634

(58) Field of Classification Search ..... 123/634, 123/635, 195 C
See application file for complete search history.

(56) References Cited

U.S. PATENT DOCUMENTS

| | | | |
|---|---|---|---|
| 5,628,298 | A | 5/1997 | Murata |
| 5,771,870 | A | 6/1998 | Satou et al. |
| 6,227,186 | B1 | 5/2001 | Seidl et al. |

FOREIGN PATENT DOCUMENTS

| | | | |
|---|---|---|---|
| JP | 06-058237 | | 3/1994 |
| JP | 09-106878 | | 4/1997 |
| JP | 2000-087837 | A | 3/2000 |
| JP | 2000-291523 | A | 10/2000 |
| JP | 2001-065444 | A | 3/2001 |
| JP | 2001065444 | * | 3/2001 |
| JP | 2007-109867 | A | 4/2007 |
| JP | 2007-116062 | A | 5/2007 |

* cited by examiner

*Primary Examiner* — Hieu T Vo
*Assistant Examiner* — Arnold Castro
(74) *Attorney, Agent, or Firm* — Crowell & Moring LLP

(57) ABSTRACT

An internal combustion engine ignition coil device has an annular seal rubber at its lower side coil. An annular projection is provided on a part of the seal rubber and is pressed against the inner diameter surface of a plug hole. An air path is formed in part of a coil case by mounting the seal rubber into a groove, enabling inside and outside portions of the plug hole to communicate. A gas-permeable thin film resin member is bonded to an inlet of the air path.

22 Claims, 12 Drawing Sheets

IGNITION COIL DEVICE FOR INTERNAL COMBUSTION ENGINE

CROSS REFERENCE TO RELATED APPLICATION

This application is a continuing application of U.S. application Ser. No. 11/597,426, filed Nov. 22, 2006, which claims priority under 35 U.S.C. §119 to PCT International Application No. PCT/JP2005/013836, filed Jul. 28, 2005, Japanese Patent Application No. 2005-091277, filed Mar. 28, 2005, and Japanese Patent Application No. 2004-220353, filed Jul. 28, 2004, the entire disclosure of which are herein expressly incorporated by reference.

TECHNICAL FIELD

The present invention relates to an ignition coil device for an internal combustion engine, which is installed for each of ignition plugs of an internal combustion engine.

BACKGROUND ART

An ignition coil device for an internal combustion engine is inserted in a plug hole formed in a cylinder head and is connected to an ignition plug. When the ignition coil device is inserted in the plug hole, or when air in the plug hole is thermally expanded with operation of the internal combustion engine, the air has to be discharged from the inside of the plug hole to the outside.

For that purpose, an air bleeding hole (groove) for enabling the inside and the outside of the plug hole to communicate with each other is formed in the ignition coil device. However, it is also required to prevent water from entering the plug hole from the outside through the air bleeding hole.

In view of the above requirement, according to a technique disclosed in Patent Document 1, water is prevented from entering the plug hole through an air vent (air bleeding hole) as follows. A first groove communicating with the outside is formed on the lower-pressure terminal socket side in an area where a seal rubber for sealing an opening of the plug hole is mounted. Further, a second groove communicating with the mounted area of the seal rubber is formed, and a third groove communicating with the second groove is formed on the lower-pressure socket side. The first groove and the third groove are communicated with each other through an enclosed space.

When water is going to enter the plug hole from the outside, the water is stored in the space and is prevented from entering the inside of the plug hole. When air is discharged from the inside of the plug hole to the outside, the water stored in the space is discharged together to the outside.

Further, as disclosed in Patent Document 2, it is also known to install filtering means in a ventilation path 41.

Patent Document 1: JP, A 2000-291523

Patent Document 2: JP, A 2000-87837

DISCLOSURE OF THE INVENTION

Problems to be Solved by the Invention

In the ignition coil device for the internal combustion engine according to the prior art, however, the air vent (air path) must be provided with a complicated labyrinth structure by forming the first to third grooves and the space, as described above, in order to ensure a reliable waterproof property. As a result, the structure of the seal rubber and the coil case, which are disposed between the ignition coil and the plug hole while ensuring the waterproof function, is complicated and increased in size, thus impeding size reduction of the ignition coil device for the internal combustion engine.

An object of the present invention is to provide an ignition coil device for an internal combustion engine, which has a superior waterproof property and can be reduced in size and easily produced.

Means for Solving the Problems

To achieve the above object, the present invention provides an ignition coil device for an internal combustion engine, the ignition coil device including a member for, in cooperation with a main coil unit, forming an air path (4) which communicates the inside and the outside of a plug hole with each other, and a filter (3) disposed midway the air path (4), wherein a space for installation of the filter (3) is defined by the main coil unit and the aforesaid member.

With that feature, the air path is simplified, and an air intake structure having a superior waterproof property can be obtained by arranging, in a part of the air path, the filter that is permeable to gas but not to liquid.

Also, because a labyrinth structure is no longer required in a seal rubber, the structure of the seal rubber is also simplified and a smaller and cheaper waterproof structure can be realized.

ADVANTAGES OF THE INVENTION

It is possible to provide the ignition coil device for the internal combustion engine, which has a superior waterproof property and can be reduced in size and easily produced.

More specifically, by simplifying the air path and installing a filter, which is permeable to gas but not to liquid, in a part of the air passage, the intake structure having a superior waterproof property can be obtained.

Further, since the labyrinth structure is no longer required in the seal rubber, the structure of the seal rubber is also simplified and a smaller and cheaper waterproof structure can be realized.

REFERENCE NUMERALS

Figure 1:
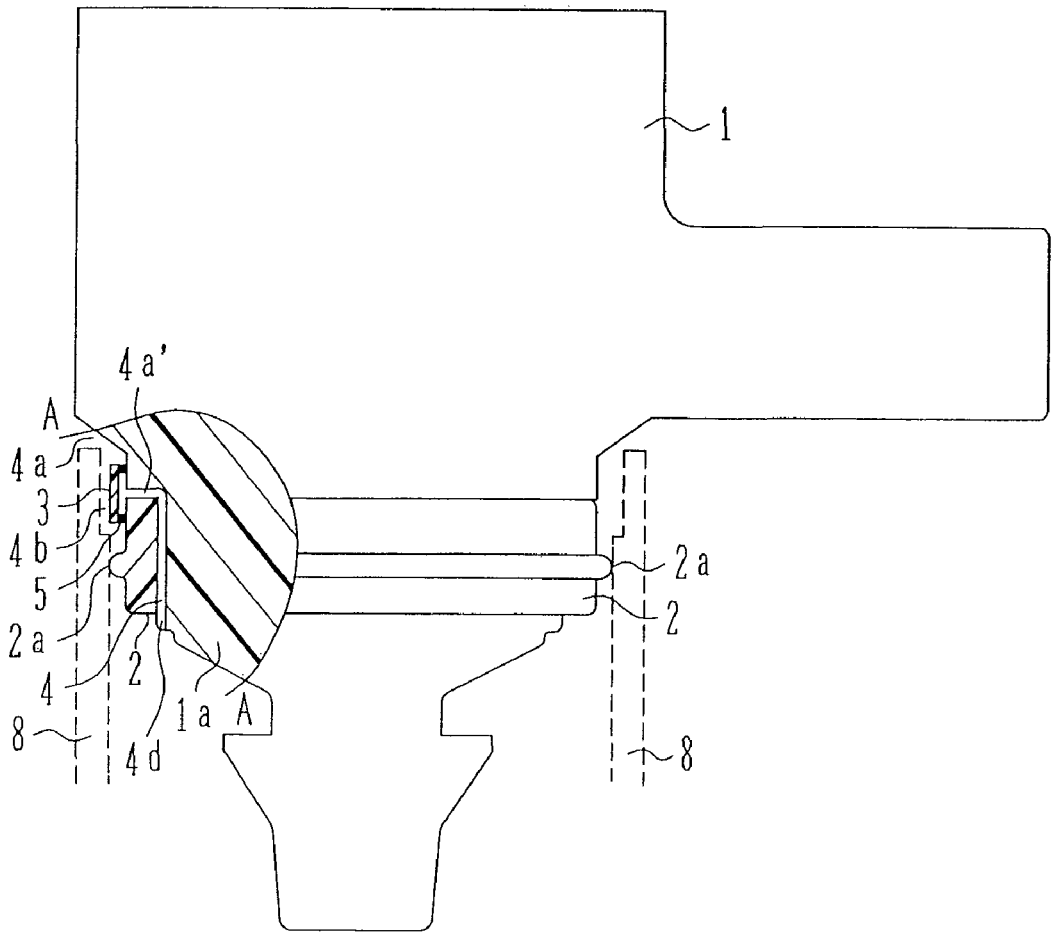
FIG. 1 is a schematic structural view, broken away in a principal part, of an ignition coil device for an internal combustion engine according to a first embodiment of the present invention.

1 . . . ignition coil
1*a* . . . coil case
1*b* . . . filter fitted area
1*c* . . . upper-side outer peripheral portion of coil case
1*d* . . . lower-side outer peripheral portion of coil case
2 . . . seal rubber
2*a* . . . projection of seal rubber
3 . . . filter
4 . . . air path
4*a* . . . intake hole inlet (intake hole)
4*b* . . . air-path enlarged portion
4*c* . . . through hole
4*d* . . . air path outlet
4*e* . . . enlarged stepped portion of air path
4*f* . . . area where thin film resin member with porous structure is fixed
5 . . . adhesive
6 . . . chamber
8 . . . plug hole
9 . . . connecting rubber

BEST MODE FOR CARRYING OUT THE INVENTION

Embodiments of the present invention will be described below with reference to the attached drawings.

FIG. 1 is a schematic structural view, broken away in a principal part, of an ignition coil device for an internal combustion engine according to a first embodiment of the present invention. Note that, in FIG. 1, a portion surrounded by the line A-A corresponds to the broken-away principal part shown in section.

Referring to FIG. 1, an annular seal rubber 2 is mounted to the lower side (as viewed in FIG. 1) of an ignition coil device 1 which is inserted in a socket portion of a plug hole 8 formed in a cylinder head (not shown). An annular projection 2*a* is provided on a part of the seal rubber 2 and is pressed against the inner surface of the plug hole 8 to ensure a waterproof property. An intake hole inlet 4*a* is formed between an opening of the plug hole 8 and the ignition coil device 1.

A substantially L-shaped groove for forming an air path 4 is formed in a part of a coil case 1*a*. The air path (air path) 4 is formed by mounting the seal rubber 2 into the groove, thus enabling the inside and the outside of the plug hole to communicate with each other.

A thin film resin member (filter) 3 with a porous structure being permeable to gas but not to liquid is fixedly bonded in an air-path enlarged portion 4*b* of the air path 4 so as to close an entrance 4*a*' of the air path in the ignition coil device 1, to thereby prevent water from entering the plug hole. Also, an air path formed between the plug hole 8 and the ignition coil device 1 is positioned upstream of the filter 3. Accordingly, respective air paths are formed upstream and downstream of the filter 3. Because the filter 3 is not exposed to EGR gas and moisture, the filter 3 can be avoided from being clogged. An air path outlet 4*d* is provided at a downstream end of the air path 4. Each of the intake hole inlet 4*a* and the air path outlet 4*d* has a cross-sectional area smaller than that of the air-path enlarged portion 4*b* in which the filter 3 is fitted.

An adhesive 5 used for bonding the thin film resin member 3 to the seal rubber 2 and the coil case 1*a* is a heat-resistant and elastic adhesive, e.g., a silicone-base adhesive. The coil case 1*a* is made of resin, e.g., polybutylene terephthalate (PBT) or poly(phenylene sulfide) (PPS). Since the thin film resin member 3 is bonded in bridging relation to two heterogeneous materials of the coil case 1*a* and the seal rubber 2, there is a possibility that a bonding force may be reduced due to the difference in contraction, which is caused by the difference in thermal expansion coefficients between the heterogeneous materials. However, the reduction of the bonding force can be avoided by using the elastic adhesive 5 (e.g., a silicone-base adhesive).

Figure 2:
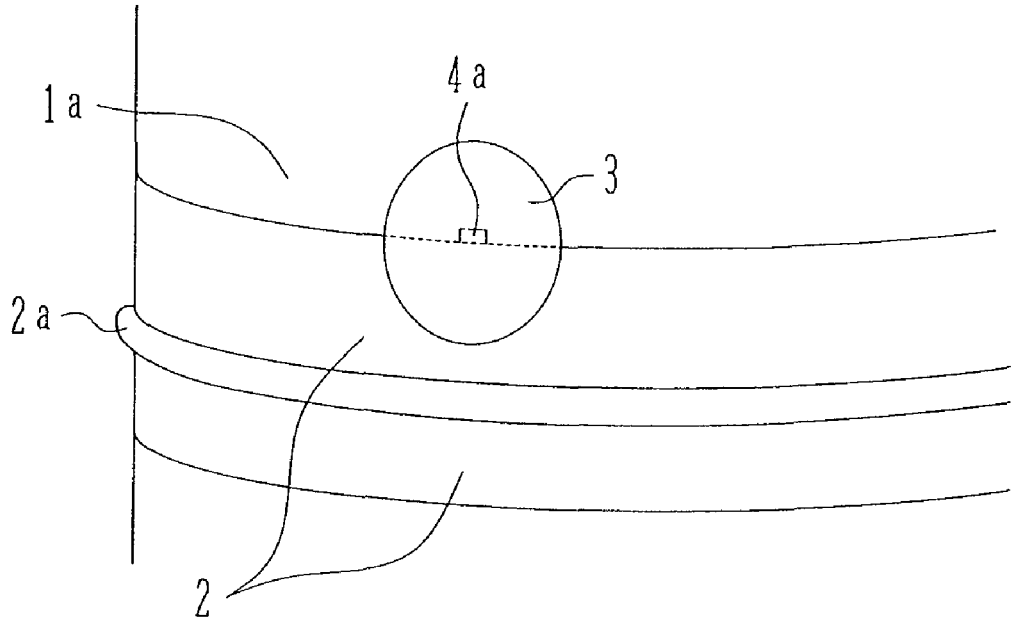
FIG. 2 is an explanatory view for explaining a principal part in the first embodiment shown in FIG. 1.

Further, by forming the thin film resin member 3 with the porous structure in a substantially circular or elliptic shape, as shown in FIG. 2, the thin film resin member 3 can be prevented from peeling off due to an external force (if the thin film resin member 3 is formed in a rectangular shape, it is apt to peel off from corners).

According to the first embodiment of the present invention, as described above, the substantially L-shaped groove is formed in the coil case 1*a*, the seal rubber 2 is mounted into the groove to form the air path, and the thin film resin member 3 is bonded to the air path inlet 4*a*, i.e., an outer-side opening of the air path, thereby ensuring a waterproof property.

As a result, the waterproof function can be provided with a simple structure, and the ignition coil device for the internal combustion engine, having a superior waterproof property and capable of reducing its size, can be realized.

Further, since the air path can be formed by forming the substantially L-shaped groove in the coil case 1*a* and mounting the seal rubber 2 into the groove, the ignition coil device for the internal combustion engine can be easily produced.

Figure 3:
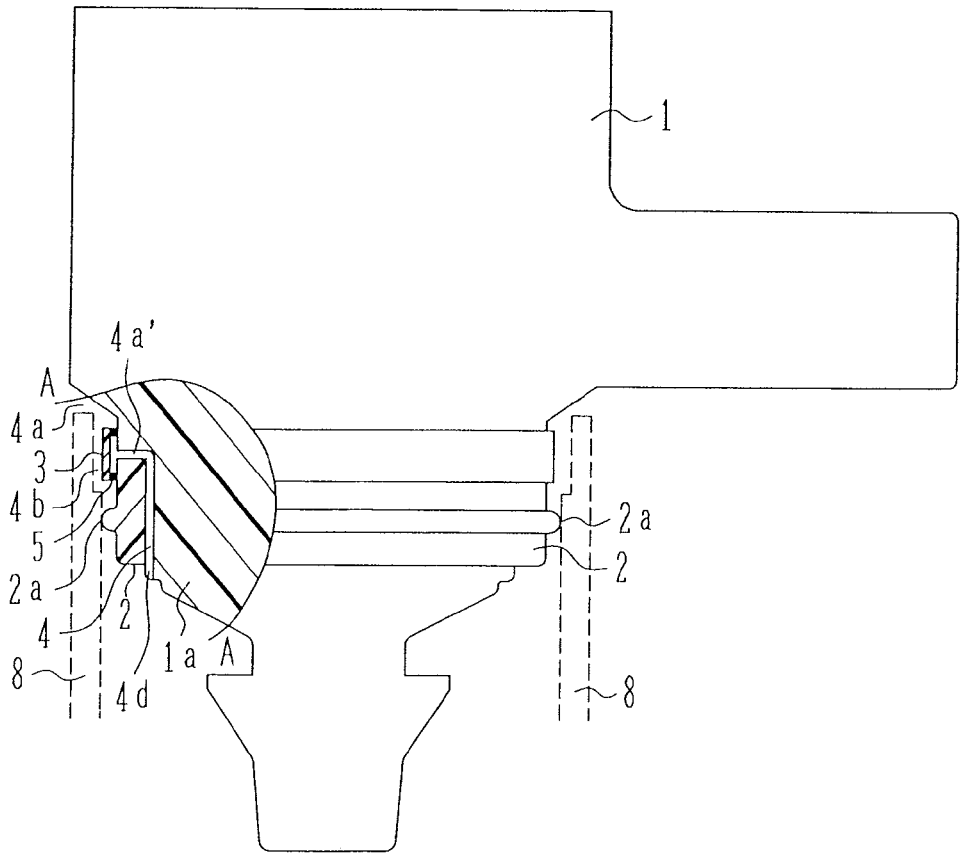
FIG. 3 is a schematic structural view, broken away in a principal part, of an ignition coil device for an internal combustion engine according to a second embodiment of the present invention.

FIG. 3 is a schematic structural view, broken away in a principal part, of an ignition coil device for an internal combustion engine according to a second embodiment of the present invention. Note that, as in FIG. 1, a portion surrounded by the line A-A in FIG. 3 corresponds to the broken-away principal part shown in section.

While FIG. 1 represents the case in which the substantially circular thin film resin member 3 is bonded just around the air path inlet 4*a*, FIG. 3 represents the case in which the thin film resin member 3 with the porous structure is installed in the form of a circular ring.

In FIG. 3, the thin film resin member 3 with the porous structure has a tape-like shape (rectangular shape), and an adhesive 5 is coated on opposite end portions of the thin film resin member 3 along its long side. By fixedly bonding the tape-like thin film resin member 3 with the porous structure over an entire circumference of the coil case 1*a* so as to cover the air path inlet 4*a*, a waterproof property at the interface between the coil case 1*a* and the seal rubber 2 can be increased, and a more superior sealing structure can be realized.

Thus, according to the second embodiment of the present invention, a more superior sealing structure can be obtained in addition to the same advantages as those in the first embodiment.

Figure 4:
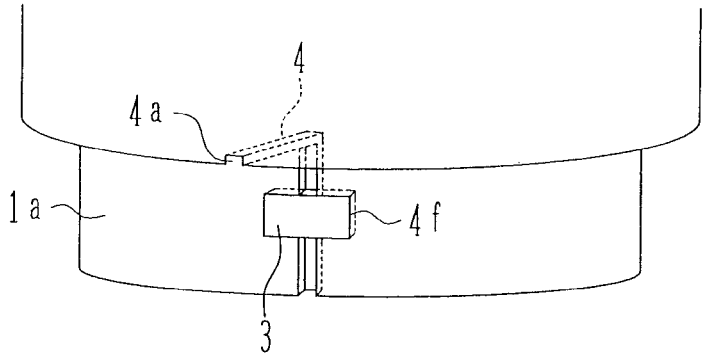
FIG. 4 is an enlarged view of a principal part of an ignition coil device for an internal combustion engine according to a third embodiment of the present invention.

FIG. 4 is a schematic enlarged view of a principal part of an ignition coil device for an internal combustion engine according to a third embodiment of the present invention.

While the above-described first and second embodiments represent the case in which the thin film resin member 3 with the porous structure is fixedly bonded to the inlet (air path inlet) 4*a* of the air path 4, the third embodiment represents the case in which the thin film resin member 3 with the porous structure is installed midway the air path 4.

FIG. 4 shows the structure of the air path 4 in a state before the seal rubber 2 is mounted.

Because the air path 4 is formed in a very narrow width of 0.5-1.0 mm in the present invention, it is difficult to fix the thin film resin member 3 with the porous structure in the air path 4 having such a very narrow width.

To enable the thin film resin member 3 to be easily fixed in place, therefore, the width in a part of the air path 4 is enlarged to form an enlarged path portion, thus forming a thin-film resin member fixed area 4*f* where the thin film resin member 3 with the porous structure is to be inserted and fixed. An adhesive 5 is coated on the rear surface of the thin film resin member 3 with the porous structure so that the thin film resin member 3 can be easily fixed to the coil case 1*a*. The thin film resin member 3 can be fixed in place by using the adhesive 5 as described above. As an alternative, the thin film resin member 3 may be fixed by fusing under heat or an ultrasonic wave because the counterpart member, i.e., the coil case 1*a*, is made of resin.

In the case of the structure shown in FIG. 4, since the thin film resin member 3 is positioned inside the seal rubber 2, a possibility of the thin film resin member 3 being peeled off by an external force is reduced.

Thus, according to the third embodiment of the present invention, in addition to the same advantages as those in the first embodiment, the following advantages can be obtained. As mentioned above, a possibility of the thin film resin member 3 being peeled off by an external force is reduced. Further, since the thin film resin member 3 with the porous structure is less contaminated, reliability can be increased.

Figure 5:
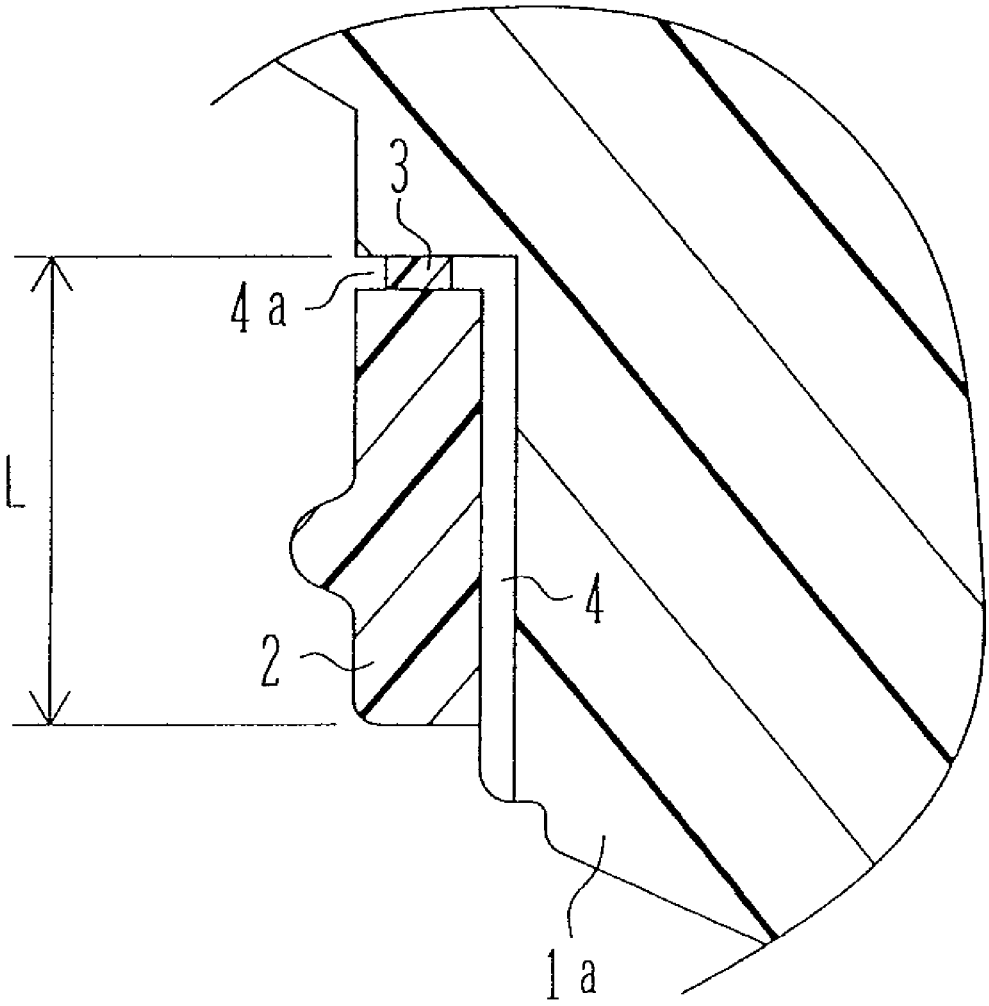
FIG. 5 shows a modification of the third embodiment of the present invention.

While the third embodiment of the present invention is described as fixing the thin film resin member 3 with the porous structure on a vertical side surface of the coil case 1*a*, the thin film resin member 3 may be installed along a horizontal surface of the coil case 1*a* as shown in FIG. 5. With such a modification, since intrusion of water is prevented at a position nearer to the air path inlet 4*a*, a more reliable waterproof property can be expected.

In addition, according to the present invention, since a complicated labyrinth structure is no longer required and the coil case and the seal rubber can be formed in a simpler structure, a height L (see FIG. 5) of the sealing structure can be reduced about 40% in comparison with that in the known ignition coil device.

Figure 6:
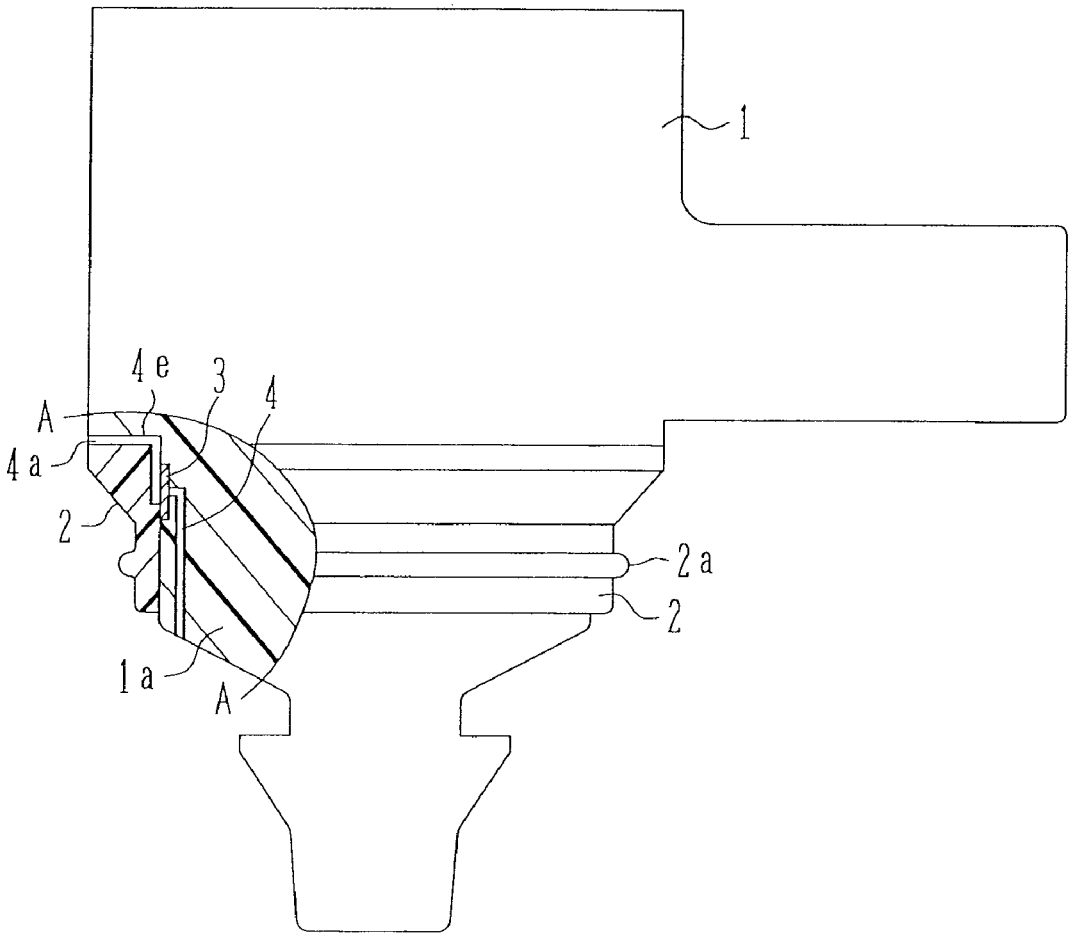
FIG. 6 is a schematic structural view, broken away in a principal part, of an ignition coil device for an internal combustion engine according to a fourth embodiment of the present invention.

FIG. 6 is a schematic structural view, broken away in a principal part, of an ignition coil device for an internal combustion engine according to a fourth embodiment of the present invention. Note that, as in FIG. 1, a portion surrounded by the line A-A in FIG. 6 corresponds to the broken-away principal part shown in section.

FIG. 6 represents the case in which the air path 4 is formed including a through hole formed inside the coil case 1*a*. Specifically, the air path 4 is made up of the through hole formed inside the coil case 1*a*, and a path defined by a groove 4*e* formed in the surface of the coil case 1*a* and the inner surface of the seal rubber 2. The thin film resin member 3 is not fixed so as to close the intake hole inlet 4*a*, and it is fixed to the coil case 1*a*.

The fourth embodiment of the present invention can also provide the same advantages as those in the third embodiment.

Figure 7:
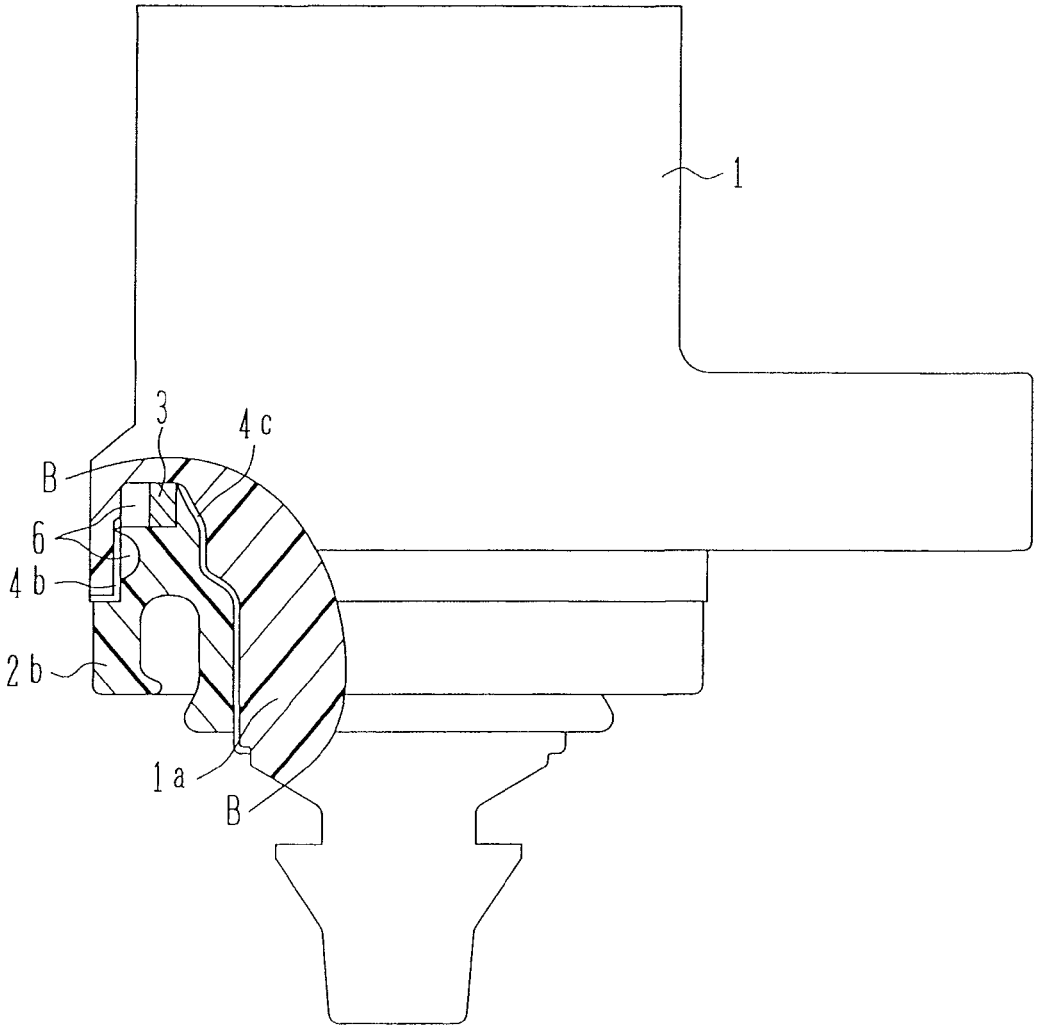
FIG. 7 is a schematic structural view, broken away in a principal part, of an ignition coil device for an internal combustion engine according to a fifth embodiment of the present invention.

FIG. 7 is a schematic structural view, broken away in a principal part, of an ignition coil device for an internal combustion engine according to a fifth embodiment of the present invention. Note that, in FIG. 7, a portion surrounded by the line B-B corresponds to the broken-away principal part shown in section.

To prevent intrusion of water, as shown in FIG. 7, a seal rubber 2*b* is designed to have an elaborate shape such that a path structure is made rather complex and a chamber (space) 6 for storing water is formed midway each of air paths 4*b* and 4*c*. A filter 3 is disposed so as to close an inlet of the air path 4*c* and an outlet of the air path 4*b*.

While, in the above-described embodiments, the thin film resin member made of a material having the porous structure is fixed to the coil case 1*a*, etc. by using an adhesive, the thin film resin member may be fixed by fusing under heat or an ultrasonic wave instead of using the adhesive.

Figure 8:
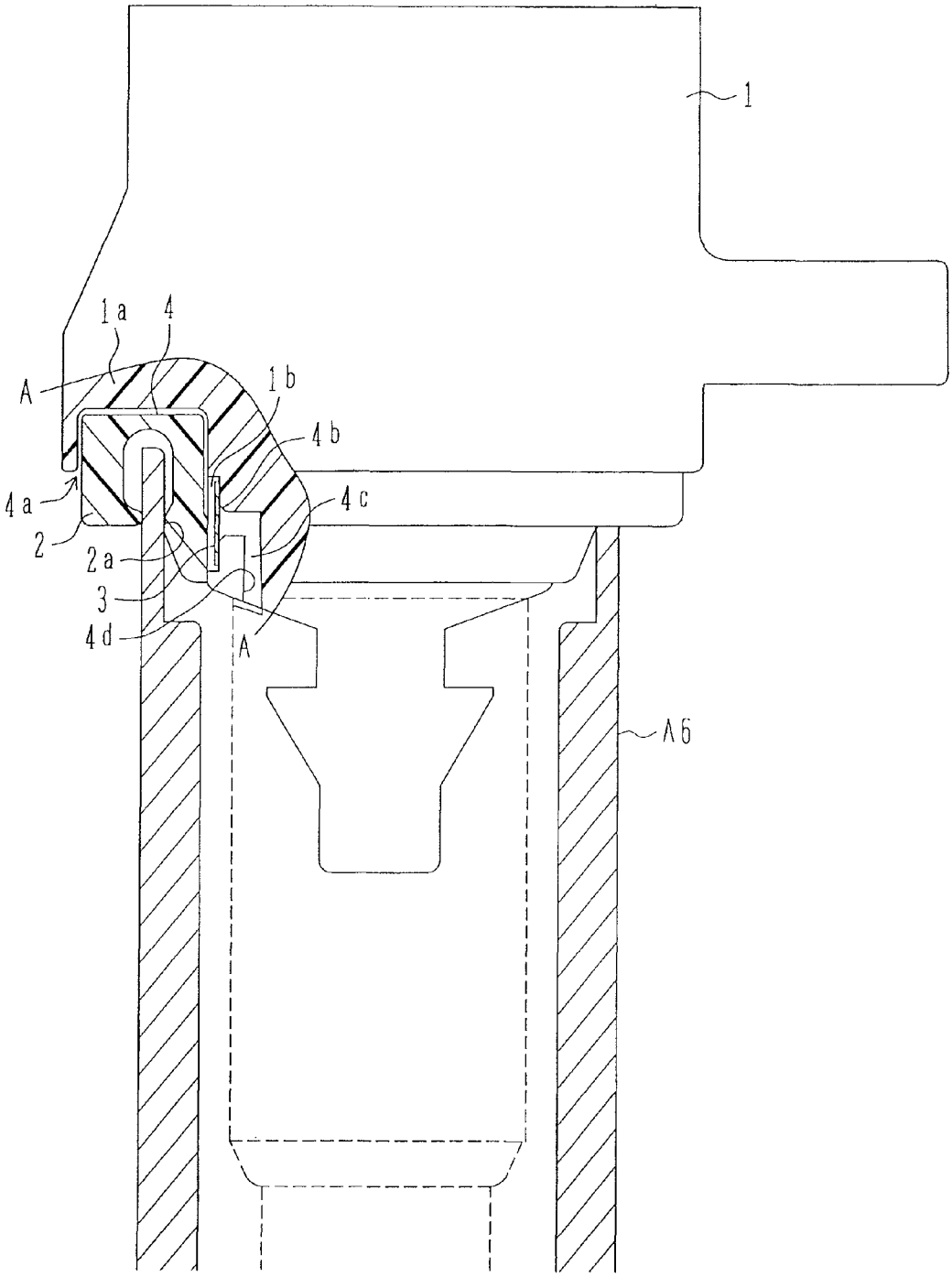
FIG. 8 is a structural view, broken away in a principal part, showing a sixth embodiment of the ignition coil device for the internal combustion engine according to the present invention.

FIG. 8 shows a sixth embodiment of the ignition coil device for the internal combustion engine according to the present invention.

FIG. 8 is a schematic structural view, broken away in a principal part, of the ignition coil device for the internal combustion engine. Note that, in FIG. 8, a portion surrounded by the line A-A corresponds to the broken-away principal part shown in section.

Referring to FIG. 8, a ring-shaped groove is formed in a coil case 1*a* at the lower side (as viewed in FIG. 8) of an ignition coil device 1 which is inserted in a socket portion of a plug hole 8 formed in a cylinder head (not shown). A seal rubber 2 made of an annular elastic body is fitted to the ring-shaped groove. An annular projection 2*a* is provided on a part of the seal rubber 2 and is pressed against the inner surface of the plug hole 8 to ensure a waterproof property. A connecting rubber 9 is mounted to a distal end of the ignition coil device 1.

The ring-shaped groove provides a gap to define an air path 4 formed by respective parts of the coil case 1*a* and the seal rubber 2. By mounting the seal rubber 2 into the groove, the air path (air path) 4 extending until reaching a thin film resin member 3 is formed. Further, a recess 1*b* is formed in a part of the coil case 1*a* such that the recess 1*b* provides an area where the filter is to be fitted. By fitting the filter 3 in the filter fitted area (recess) 1*b* and forming a through hole 4*c* at a center of the filter fitted area (recess) 1*b* to be communicated with the filter fitted area (recess) 1*b*, the inside and the outside of the plug hole 8 can be held in communication with each other.

The filter 3 has fine holes, and the presence of the fine holes gives the filter such a property that it is permeable to gas but not to liquid. Thus, water is prevented from entering the plug hole 8. The filter 3 is made of, e.g., a porous film of tetrafluoroethylene.

When the filter 3 is fixedly fused to the coil case 1*a* by using a welding jig, the following problem arises. The diameter of the through hole 4*c* formed in the coil case 1*a* is in the range of about ϕ0.5-ϕ2 at maximum from a limitation in allowable space. The resin of the coil case 1*a* is melted and deformed in a direction to close the through hole 4*c* with the fusing of the filter 3. To prevent the through hole 4*c* from being closed by the deformation of the resin, therefore, it is required to enlarge a part of the through hole 4*c*, i.e., an opening of the through hole 4*c* on the side near the filter fitted area (recess) 1*b*, to thereby form an enlarged portion of the opening.

Figure 9:
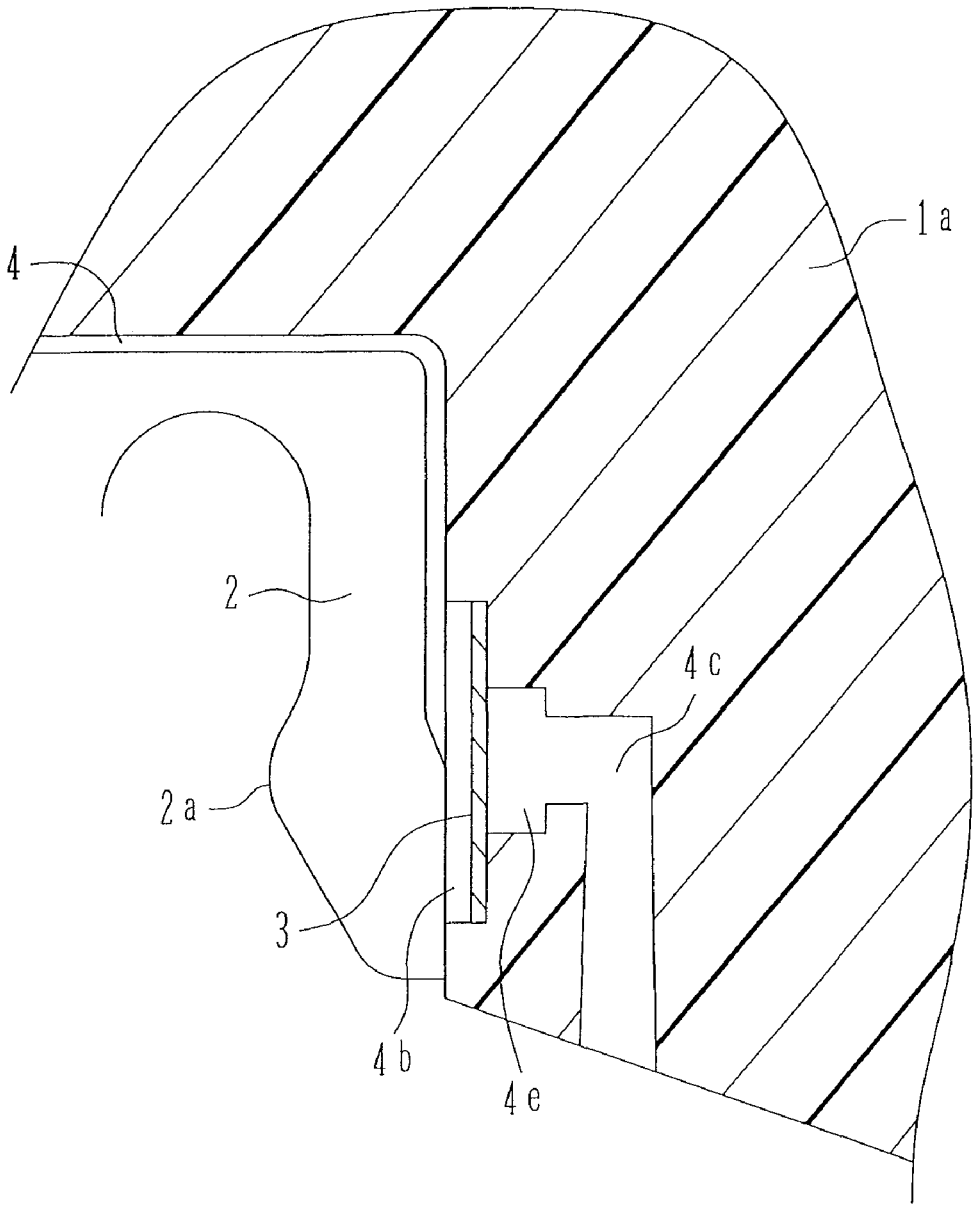
FIG. 9 is a structural view of a broken-away principal part in the ignition coil device for the internal combustion engine according to the embodiment shown in FIG. 8, the view showing an example of an enlarged portion of an opening on the side near a filter fitted area.

As one practical method, the enlarged portion of the opening on the side near the filter fitted area (recess) 1*b* can be obtained by spreading the opening in an inclined form 4*b*, by way of example, as shown in FIG. 8. As another practical method, the enlarged portion of the opening on the side near the filter fitted area (recess) 1*b* may be obtained by enlarging the opening in the stepped form 4*e*, as shown in FIG. 9.

Thus, according to this sixth embodiment having the above-described structure, since a part of the through hole 4*c* forming the air path 4, which is opened to the fitted area (recess) 1*b* where the filter 3 is fitted, is enlarged in the inclined form 4*b*, etc., it is possible to prevent the air path 4*c* from being closed when the filter 3 is fixed in place, and to reliably ensure an air intake capability and a waterproof property.

Figure 10:
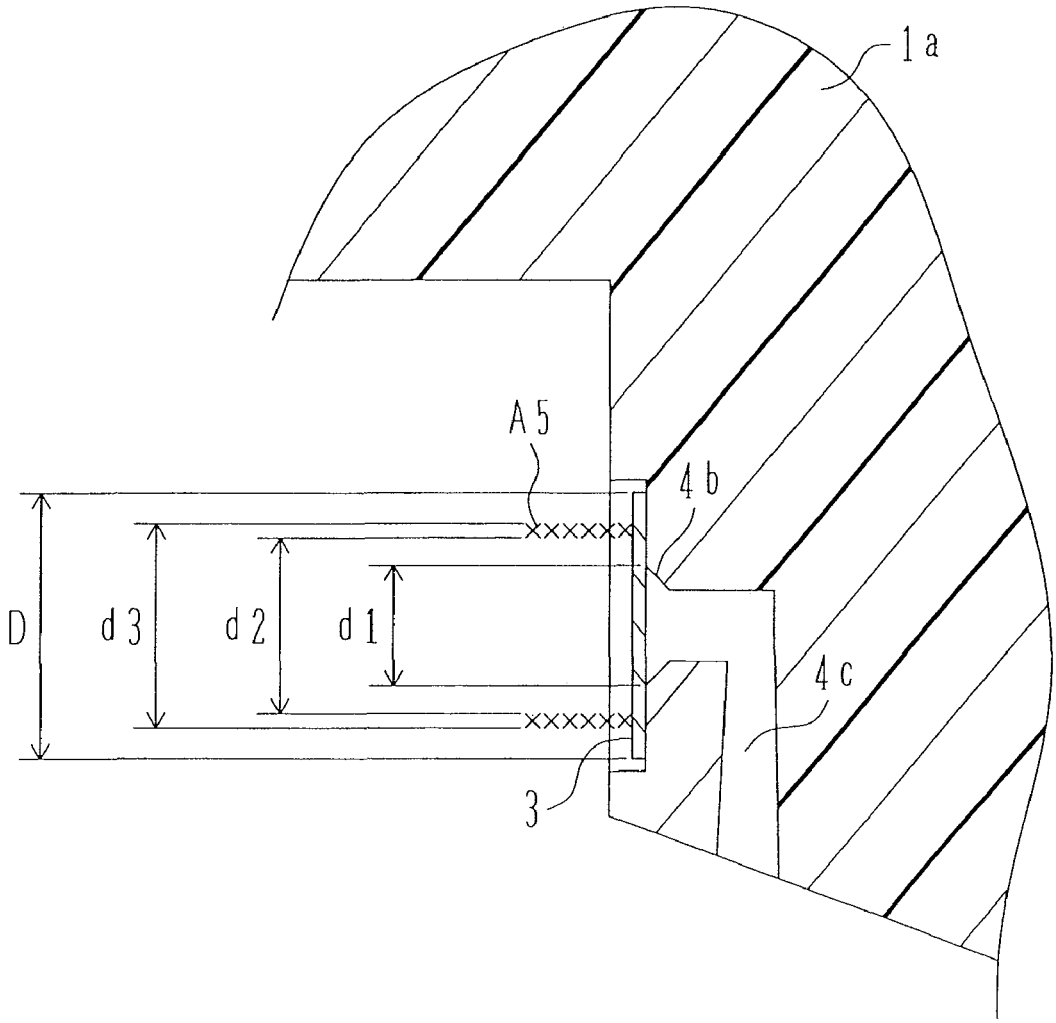
FIG. 10 is a structural view of a broken-away principal part, which shows a seventh embodiment of the ignition coil device for the internal combustion engine according to the present invention.

FIG. 10 shows a seventh embodiment of the ignition coil device for the internal combustion engine according to the present invention. Specifically, FIG. 10 shows the dimensional relationship in the structure of the ignition coil device for the internal combustion engine according to the seventh embodiment.

In the ignition coil device for the internal combustion engine according to the seventh embodiment, assuming as shown in FIG. 10 that the diameter of the enlarged portion (inclined form) 4*b* of the through hole 4*c* forming the air path 4 is d1, the outer diameter of the filter 3 is D, the inner diameter of the fusing jig is d2, and the outer diameter of the fusing jig is d3, these parameters are set so satisfy the relationships given below:

$$D>d2>d1$$

and $$d3<D$$

With such setting, when the filter 3 is fixed by fusing, the resin defining a part of the through hole 4*c* serving as the air path 4, i.e., the resin around the enlarged portion (inclined form) 4*b*, is stably melted together with the porous structure member 3, and reliability of the fusing can be ensured. In addition, the difference between the inner diameter d2 of the fusing jig and the diameter d1 of the enlarged portion of the air path is preferably ϕ0.5 or more from the viewpoint of providing an allowance for a variation in the fusing operation.

Figure 11:
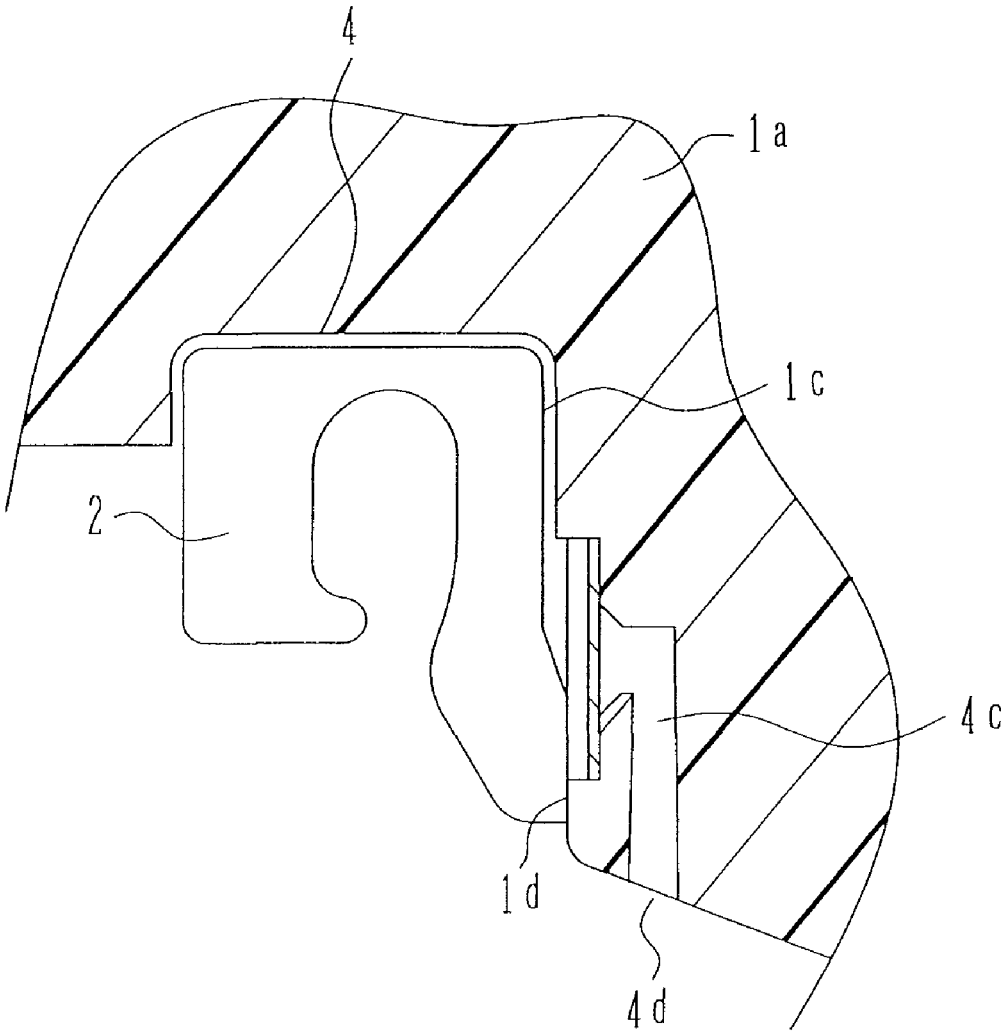
FIG. 11 is a structural view of a broken-away principal part, which shows an eighth embodiment of the ignition coil device for the internal combustion engine according to the present invention.

FIG. 11 shows an eighth embodiment of the ignition coil device for the internal combustion engine according to the present invention.

In the ignition coil device for the internal combustion engine according to this embodiment, a ring-shaped groove for providing a gap to define the air path 4 extending from an end opened to the outside to the porous structure member 3 must be formed in a part of the coil case 1*a*. The ring-shaped groove can be formed only by withdrawing a mold in a direction toward the plug side. If the inner-side outer diameter 1*c* of the ring-shaped groove formed in the coil case 1*a*, into which is mounted the seal rubber 2 (i.e., the diameter 1*c* of the outer periphery of the coil case 1*a* just above the porous structure film member 3), is set equal to the case outer diameter 1*d* defining a sealing surface formed by the seal rubber 2 and the coil case 1*a* on the side nearer to the plug (i.e., the diameter 1*d* of the outer periphery of the coil case below the porous structure film member 3), the gap is also formed at the case outer periphery 1*d* defining the sealing surface formed by the seal rubber 2 and the coil case 1*a* on the side nearer to the plug (i.e., the outer periphery 1*c* of the coil case below the porous structure film member 3).

Therefore, the inner-side outer diameter 1*c* of the ring-shaped groove formed in the coil case 1*a*, into which is mounted the seal rubber 2 (i.e., the diameter 1*c* of the outer periphery of the coil case 1*a* just above the porous structure film member 3) is required to be relatively smaller by a value equal to or larger than the depth of the gap to be formed. Also, a waterproof property is ensured by pressing the seal rubber 2 against the case outer periphery 1*c* defining the sealing surface formed by the seal rubber 2 and the coil case 1*a* on the side nearer to the plug (i.e., the outer periphery 1*d* of the coil case below the porous structure film member 3), to thereby establish sealing.

Further, a through hole 4*c* provided in the coil case 1*a* to define the air path 4 is formed in an inclined shape gradually spreading toward an opening 4*d* of the through hole 4*c*, which is positioned to be open to the plug hole 8. With such a structure, formability in molding of the coil case 1*a* having a relatively complex shape can be increased.

Figure 12:
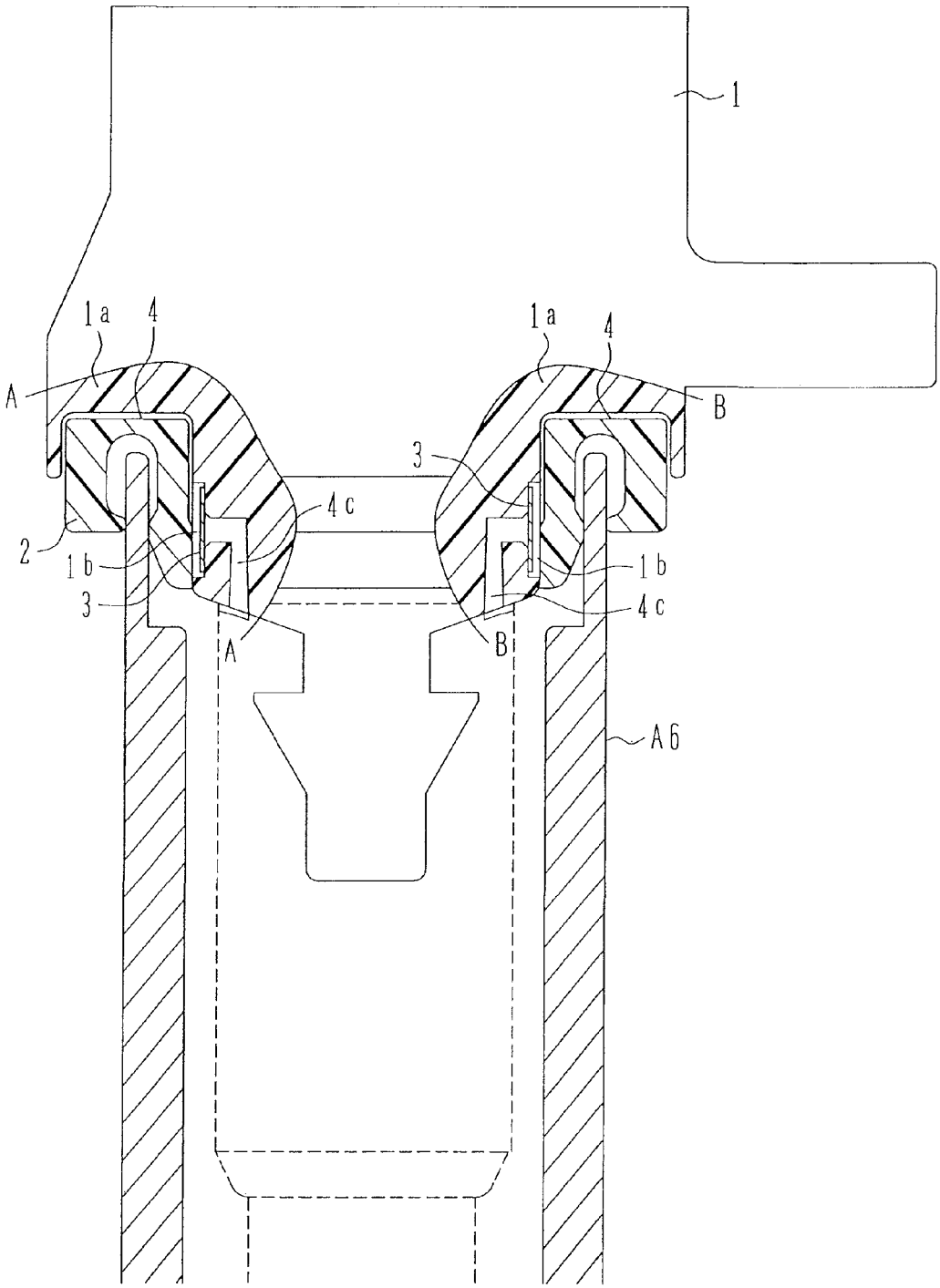
FIG. 12 is a structural view of a broken-away principal part, which shows a ninth embodiment of the ignition coil device for the internal combustion engine according to the present invention.

FIG. 12 shows a ninth embodiment of the ignition coil device for the internal combustion engine according to the present invention.

FIG. 12 is a schematic structural view, broken away in a principal part, of the ignition coil device for the internal combustion engine. Note that, in FIG. 12, a portion surrounded by the line A-A and a portion surrounded by the line B-B each correspond to the broken-away principal part shown in section.

Referring to FIG. 12, a ring-shaped groove is formed in a coil case 1*a* at the lower side (as viewed in FIG. 12) of an ignition coil device 1 which is inserted in a socket portion of a plug hole 8 formed in a cylinder head (not shown). A seal rubber 2 made of an annular elastic body is fitted to the ring-shaped groove.

The ring-shaped groove provides a gap to define an air path 4 formed by respective parts of the coil case 1*a* and the seal rubber 2. By mounting the seal rubber 2 into the groove, the air path (air path) 4 extending until reaching a porous structure member 3 is formed. Further, a recess 1*b* is formed in a part of the coil case 1*a* such that the recess 1*b* provides an area where the filter is to be fitted. By fitting the filter 3 in the filter fitted area (recess) 1*b* and forming a through hole 4*c* at a center of the filter fitted area (recess) 1*b* to be communicated with the filter fitted area (recess) 1*b*, the inside and the outside of the plug hole 8 can be held in communication with each other.

The filter 3 has fine holes, and the presence of the fine holes gives the filter such a property that it is permeable to gas but not to liquid. Thus, water is prevented from entering the plug hole 8. The filter 3 is made of, e.g., a porous film of tetrafluoroethylene.

In this ninth embodiment, the filter fitted area formed by the recess 1*b* is provided at two positions in the air path 4. Further, the porous structure member 3 is fitted in each of the two filter fitted areas (recesses) 1*b*, and the through hole 4*c* is formed at a center of each of the two filter fitted areas (recesses) 1*b* to be communicated with the corresponding filter fitted area (recess) 1*b*, thereby enabling the inside and the outside of the plug hole 8 to communicate with each other.

Figure 13:
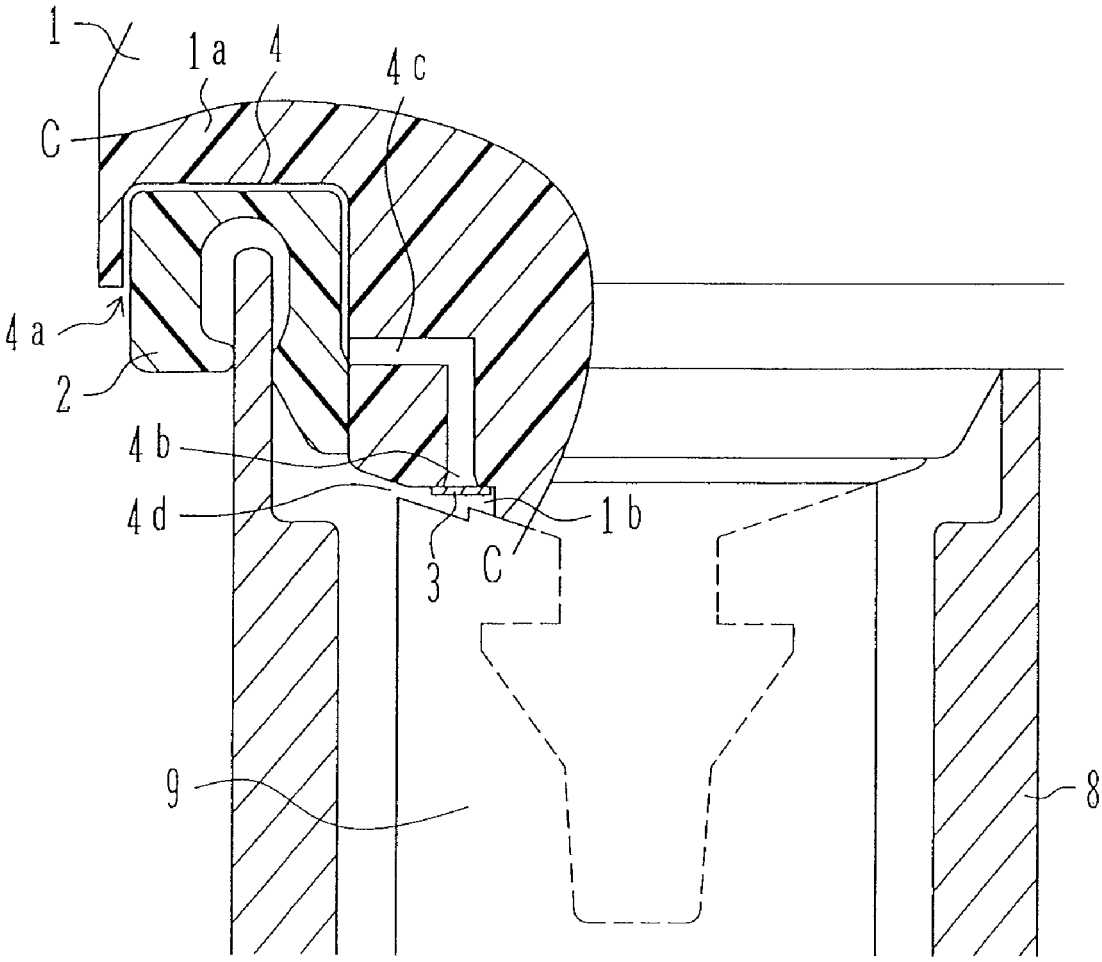
FIG. 13 is a structural view of a broken-away principal part, which shows a tenth embodiment of the ignition coil device for the internal combustion engine according to the present invention.

FIG. 13 shows a tenth embodiment of the ignition coil device for the internal combustion engine according to the present invention.

FIG. 13 is a schematic structural view, broken away in a principal part, of the ignition coil device for the internal combustion engine. Note that, in FIG. 13, a portion surrounded by the line C-C corresponds to the broken-away principal part shown in section.

Referring to FIG. 13, a ring-shaped groove is formed in a coil case 1*a* at the lower side (as viewed in FIG. 13) of an ignition coil device 1 which is inserted in a socket portion of a plug hole 8 formed in a cylinder head. A seal rubber 2 made of an annular elastic body is fitted to the ring-shaped groove. A connecting rubber 9 is mounted to a distal end of the ignition coil 1.

The ring-shaped groove provides a gap to define an air path 4 formed by respective parts of the coil case 1*a* and the seal rubber 2. By mounting the seal rubber 2 into the groove, the air path (air path) 4 extending until reaching a porous structure member 3 is formed. The air path (air path) 4 is further provided by a through hole 4*c* which is formed to penetrate the coil case 1*a* and to be opened to the inside of the plug hole 8. An area 1*b* where the filter 3 is to be fitted is formed in an opening of the through hole 4*c* on the side opened to plug hole 8, and the filter 3 is fitted in the filter fitted area 1*b*. An air path inlet 4*a* is formed between the ignition coil 1 and the seal rubber 2, and an air path outlet 4*d* is formed between the connecting rubber 9 and the ignition coil 1.

The filter 3 has fine holes, and the presence of the fine holes gives the filter such a property that it is permeable to gas but not to liquid. Thus, water is prevented from entering the plug hole 8. The filter 3 is made of, e.g., a porous film of tetrafluoroethylene.

In the above-described embodiments, the filter 3 can be fixed in place by bonding with a double-faced tape, thermal crimping, or fusing that is usable when the counterpart member is made of resin. When the ignition coil for the internal combustion engine is used under severe conditions such as a temperature range of −40° C. to 150° C., the thermal crimping or the fusing is preferable. However, in the case of the ignition coil being required to have a size as small as possible, the fusing is optimum because it necessitates a minimum space. Since the coil case 1*a* is made of resin, e.g., polybutylene terephthalate (PBT) or poly(phenylene sulfide) (PPS), the fusing can be performed at temperature lower than the heat-resistant temperature of the tetrafluoroethylene resin that is used for the porous structure member 3. Accordingly, the filter 3 can be fixed in place at high fixing strength without damaging the filter.

The invention claimed is:

1. An ignition coil device for an internal combustion engine, comprising:

a main coil unit, forming an air path which communicates the inside and the outside of a plug hole with each other, and a filter disposed in a middle portion of said air path, wherein a space for installation of said filter is defined by said main coil unit and a member, and said air path located at at least one of the upper and lower sides of the space for installation of said filter is formed by said main coil unit and said member.

2. The ignition coil device for the internal combustion engine according to claim 1, further including an elastic body inserted in said plug hole formed in a cylinder of said internal combustion engine, connected to an ignition plug, and sealing an opening of said plug hole in a waterproof manner, wherein the filter being permeable to gas but not to liquid is disposed in said air path which communicates the inside and the outside of said plug hole with each other.

3. An ignition coil device for an internal combustion engine, comprising:

a main coil unit, forming an air path which communicates the inside and the outside of a plug hole with each other, and a filter disposed in a middle portion of said air path, wherein a space for installation of said filter is defined by said main coil unit and a member, and said air path located at at least one of the upper and lower sides of the space for installation of said filter is formed by said main coil unit and said member, further comprising an elastic body inserted in said plug hole formed in a cylinder of said internal combustion engine, connected to an ignition plug, and sealing an opening of said plug hole in a waterproof manner, wherein the filter being permeable to gas but not to liquid is disposed in said air path which communicates the inside and the outside of said plug hole with each other, wherein said filter is disposed in covering relation to an opening of said air path, which is opened to the outside of said plug hole.

4. The ignition coil device for the internal combustion engine according to claim 3, wherein said filter has a substantially circular shape.

5. The ignition coil device for the internal combustion engine according to claim 3, wherein said filter has a rectangular shape in cross-section, and the filter having a rectangular cross-section is fixed to an area surrounding and including the opening of said air path, which is opened to the outside of said plug hole.

6. The ignition coil device for the internal combustion engine according to claim 2, wherein an enlarged path portion is formed in a part of said air path, and said filter is fixed in said enlarged path portion.

7. The ignition coil device for the internal combustion engine according to claim 6, wherein an enlarged path portion is formed near the opening of said air path, which is opened to the outside of said plug hole.

8. The ignition coil device for the internal combustion engine according to claim 2, wherein said elastic body is made of rubber and is mounted over an outer periphery of a case of said ignition coil device.

9. The ignition coil device for the internal combustion engine according to claim 8, wherein said filter is disposed in a part of said air path formed between said rubber and said case.

10. The ignition coil device for the internal combustion engine according to claim 8, wherein a part of said air path is formed as a through path penetrating said case, and said filter is disposed at an inlet or an outlet of said through path formed in said case.

11. The ignition coil device for the internal combustion engine according to claim 1, said ignition coil device for the internal combustion engine being of independent ignition type and being mounted in said plug hole of each cylinder of said internal combustion engine for direct coupling to an ignition plug in use, wherein a ring-shaped groove is formed in a coil case of said ignition coil device for the internal combustion engine with an elastic body mounted into said groove, said air path communicating the inside and the outside of said plug hole with each other is formed between said coil case and said elastic body, said elastic body sealing a gap between an opening of said plug hole and said ignition coil for the internal combustion engine in a waterproof manner, and the filter made of a thin film resin member with a porous structure is fitted in an area in which is to be fitted said filter and which is positioned in a part of said air path, and wherein an enlarged portion is formed in said air path on the side communicating said filter fitted area and said plug hole with each other.

12. The ignition coil device for the internal combustion engine according to claim 11, wherein said enlarged portion is provided in an inclined form in a part of said air path.

13. The ignition coil device for the internal combustion engine according to claim 11, wherein said enlarged portion is provided in a stepped form in a part of said air path.

14. The ignition coil device for the internal combustion engine according to claim 11, wherein, assuming that the diameter of an opening of said enlarged portion is d1, the outer diameter of said filter is d2, and the inner diameter of a fusing jig is D, the opening of said enlarged portion is formed to satisfy the following relationship:

$$D>d2>d1.$$

15. The ignition coil device for the internal combustion engine according to claim 11, wherein said filter is disposed in a part of said air path.

16. The ignition coil device for the internal combustion engine according to claim 11, wherein said air path on the side communicating said filter fitted area and said plug hole with each other is a through hole formed in said coil case.

17. The ignition coil device for the internal combustion engine according to claim 16, wherein said through hole formed in said coil case is in an inclined form gradually spreading toward an outer surface of said coil case.

18. The ignition coil device for the internal combustion engine according to claim 15, wherein said area in which is to be fitted said filter is formed by setting the case outer diameter defining a sealing surface formed by said elastic body and said coil case on the side nearer to a plug to be smaller than the inner-side outer diameter of said ring-shaped groove formed in said coil case, into which is mounted said elastic body, such that a step-like level difference is formed between the inner-side outer diameter of said ring-shaped groove and the case outer diameter defining said sealing surface.

19. The ignition coil device for the internal combustion engine according to claim 11, wherein said filter is formed of a porous film of tetrafluoroethylene resin.

20. The ignition coil device for the internal combustion engine according to claim 11, wherein a ring-shaped groove is formed in a coil case of said ignition coil device for the internal combustion engine with an elastic body mounted into said groove, said air path communicating the inside and the outside of said plug hole with each other is formed between said coil case and said elastic body, said elastic body sealing a gap between an opening of said plug hole and said ignition coil for the internal combustion engine in a waterproof manner, and said filter made of a thin film resin member with a porous structure is fitted in an area in which is to be fitted said filter and which is positioned in a part of said air path, and wherein said filter fitted area is provided at two or more positions in different parts of said air path, and a through hole extending from each of said filter fitted areas to be communicated with said plug hole is formed inside said coil case per said filter fitted area.

21. The ignition coil device for the internal combustion engine according to claim 11, wherein a ring-shaped groove is formed in a coil case of said ignition coil for the internal combustion engine with an elastic body mounted into said groove, said air path communicating the inside and the outside of said plug hole with each other is formed between said coil case and said elastic body, said elastic body sealing a gap between an opening of said plug hole and said ignition coil for the internal combustion engine in a waterproof manner, and said filter made of a thin film resin member with a porous structure is fitted in an area in which is to be fitted said filter and which is positioned in a part of said air path, and wherein a through hole communicating with said plug hole is formed inside said coil case near a sealing surface which is formed by said elastic body and said coil case on the side nearer to the plug, said filter fitted area is formed in an opening of said through hole on the side opened to said plug hole, and said filter is fitted in said filter fitted area.

22. The ignition coil device for the internal combustion engine according to claim 1, wherein said air path includes an air path portion which is located in an outer side of said space, is a part of a ventilation passage, and prevents penetration of water.

* * * * *